US011951347B2

(12) United States Patent
Chen

(10) Patent No.: US 11,951,347 B2
(45) Date of Patent: Apr. 9, 2024

(54) WEIGHT MEMBER AND THE USE IN BARBELL AND DUMBBELL DEVICES

(71) Applicant: Paul Chen, Taichung (TW)

(72) Inventor: Paul Chen, Taichung (TW)

(73) Assignee: FLORIEY INDUSTRIES INTERNATIONAL CO., LTD., Taichung (TW)

( * ) Notice: Subject to any disclaimer, the term of this patent is extended or adjusted under 35 U.S.C. 154(b) by 36 days.

(21) Appl. No.: 17/736,051

(22) Filed: May 3, 2022

(65) Prior Publication Data

US 2023/0356021 A1 Nov. 9, 2023

(51) Int. Cl.
*A63B 21/075* (2006.01)
*A63B 21/072* (2006.01)

(52) U.S. Cl.
CPC ..... *A63B 21/075* (2013.01); *A63B 21/0722* (2015.10); *A63B 21/0724* (2013.01); *A63B 21/0726* (2013.01); *A63B 21/0728* (2013.01)

(58) Field of Classification Search
CPC ..... A63B 21/075; A63B 21/0722; A63B 21/0724; A63B 21/0726; A63B 21/0728; A63B 21/06; A63B 21/0601; A63B 21/0604; A63B 21/0607; A63B 21/072
See application file for complete search history.

(56) References Cited

U.S. PATENT DOCUMENTS

| | | | | |
|---|---|---|---|---|
| 7,862,487 | B2 * | 1/2011 | Olson | A63B 21/075 482/98 |
| 10,583,318 | B2 * | 3/2020 | Nalley | A63B 21/0726 |
| 11,135,469 | B2 * | 10/2021 | Svenberg | A63B 21/0728 |
| 11,273,338 | B2 * | 3/2022 | Chen | A63B 71/0036 |
| 11,583,721 | B2 * | 2/2023 | Chen | A63B 21/0728 |
| 11,590,380 | B2 * | 2/2023 | Pohl | A63B 21/075 |

* cited by examiner

*Primary Examiner* — Loan B Jimenez
*Assistant Examiner* — Kathleen M Fisk

(57) ABSTRACT

A weight member and the use in barbell and dumbbell devices are provided, wherein the weight member has a first side and a second side opposite to each other, and a split groove through the first side and the second side. A first mortise and a first tenon are arranged on the first side, and a second mortise and a second tenon are arranged on the second side. The first mortise and the second tenon are arranged in opposite direction correspondingly, and the first mortise and the second tenon are opposite to each other and arranged correspondingly. When the weight members are assembled together, the first mortise and the first tenon of one weight member is sliding interlocked with the second tenon and the second mortise of another weight member respectively.

11 Claims, 12 Drawing Sheets

WEIGHT MEMBER AND THE USE IN BARBELL AND DUMBBELL DEVICES

FIELD OF THE DISCLOSURE

The present invention relates to a device in weight training, particularly to a weight member, and a weight member used in barbell and dumbbell.

BACKGROUND OF THE DISCLOSURE

Weight training is a strength training with dumbbells, barbells, kettlebells and other equipment to increase muscle strength.

In the process of weight training with equipment, an exercise facility with a function of adjusting weight is popular, for example the weight adjustable dumbbell devices as disclosed in Taiwan Patent No. M612149, No. M611706, No. M610510, No. M595525, No. M592775 and so on. For example, the devices with both dumbbell and barbell operating modes, as well as adjustable weight as disclosed in Taiwan patent No. M613036, No. M594976, and the U.S. patent Ser. No. 11/207,557B2.

However, the assembling of the weight members (weight plates) in the above-mentioned patents is mostly based on the mutual engagement of the dovetail and the dovetail groove, and the joint structure is mostly located at a single center position of the weight member (weight plate). During the weight training, the device is held by hand(s), and kept moving by the training movement. Part of the gravity would be held by the weight adjustment and latching mechanism, still part of gravity will be applied to the joint structure and cause the abrasion on the part.

SUMMARY OF THE DISCLOSURE

A weight member and the use in barbell and dumbbell devices, wherein the weight member has a first side and a second side opposite to each other, and a split groove through the first side and the second side. A first mortise and a first tenon are arranged on the first side, and a second mortise and a second tenon are arranged on the second side. The first mortise and the second tenon are arranged in opposite direction correspondingly, and the first mortise and the second tenon are opposite to each other and arranged correspondingly.

In operation of the weight member of the present invention, when the weight members are assembled together, the first mortise and the first tenon of the first side of one weight member is sliding interlocked with the second tenon and the second mortise of the second side of another weight member respectively.

A barbell and dumbbell device, comprising: a base; a fastening plate, disposed on the base; a movable plate, placed on the base, a near position is provided when the movable plate is moved adjacent to the fastening plate, and a distant position is provided when the movable plate is moved away and spaced apart from the fastening plate, so that the movable plate is movable between the near position and the distant position; a weight members, disposed between the fastening plate and the movable plate moveably; the weight member has a first side and a second side opposite to each other, and the weight member has a split groove through the first side and the second side; the first side has a first mortise and a first tenon, and the split groove is located between the first mortise and the first tenon, and the second side has a second tenon and a second mortise, and the split groove is located between the second tenon and the second mortise; the first mortise and the second tenon are arranged in opposite direction correspondingly, and the first tenon and the second mortise are arranged opposite to each other correspondingly; the first mortise and the first tenon of one weight member is sliding interlocked with the second tenon and the second mortise of another weight member respectively; a barbell bar, a barbell mode is provided when both ends of the barbell bar engage with the weight members of the movable plates located at the near positions respectively; and a dumbbell bar, a dumbbell mode is provided when both ends of the dumbbell bar engage with the weight members of the fastening plate and the weight members of the movable plate located at the distant position respectively.

By virtue of the arrangement where the first mortise and the first tenon are disposed on the first side, the second mortise and the second tenon are disposed on the second side, the first mortise and the second tenon are arranged in opposite direction, and the first mortise and the second tenon are arranged in opposite direction, the first mortise and the first tenon of the first side 110 of one weight member can be sliding interlocked with the second tenon and the second mortise of the second side of another weight member respectively when the weight members are assembled with each other. Thus, the strength of the structural combination between the two weight members is improved, part of the gravity can be dispersed in the sliding interlocked portions during the weight training operation, so as to overcome the disadvantage in conventional art.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
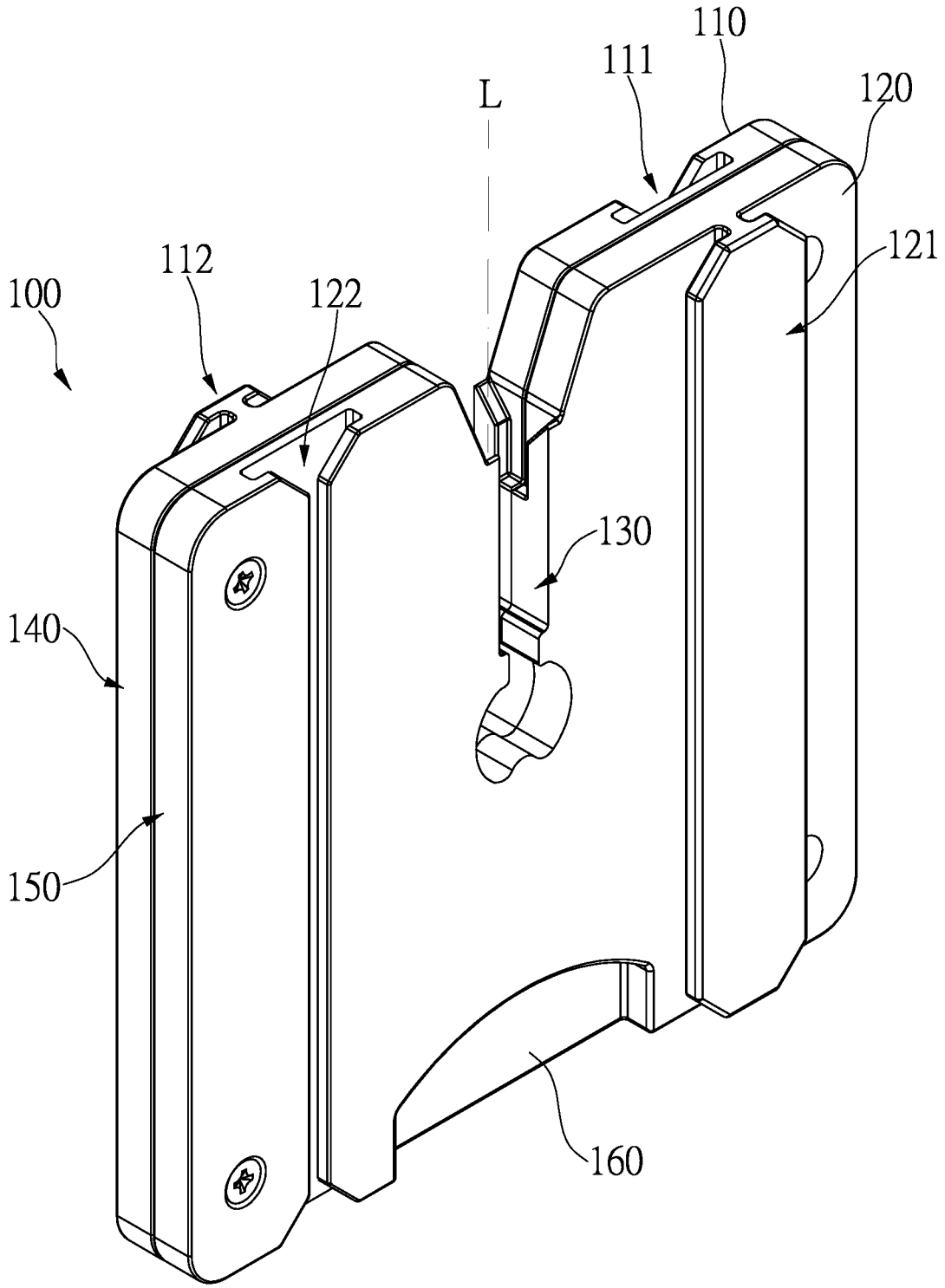
FIG. 1 is a perspective schematic view of a weight member.
Figure 2:
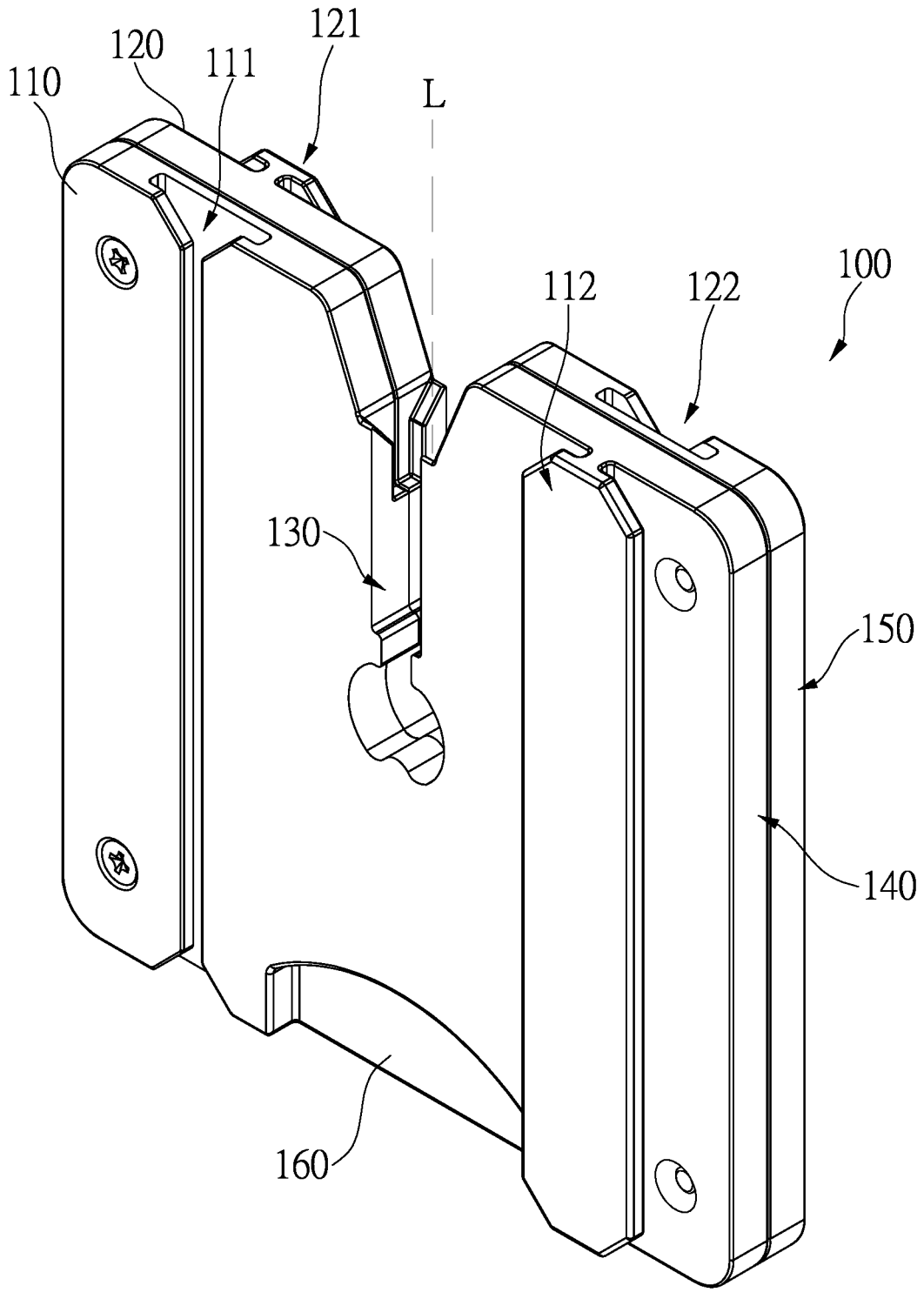
FIG. 2 is another schematic perspective view.
Figure 3:
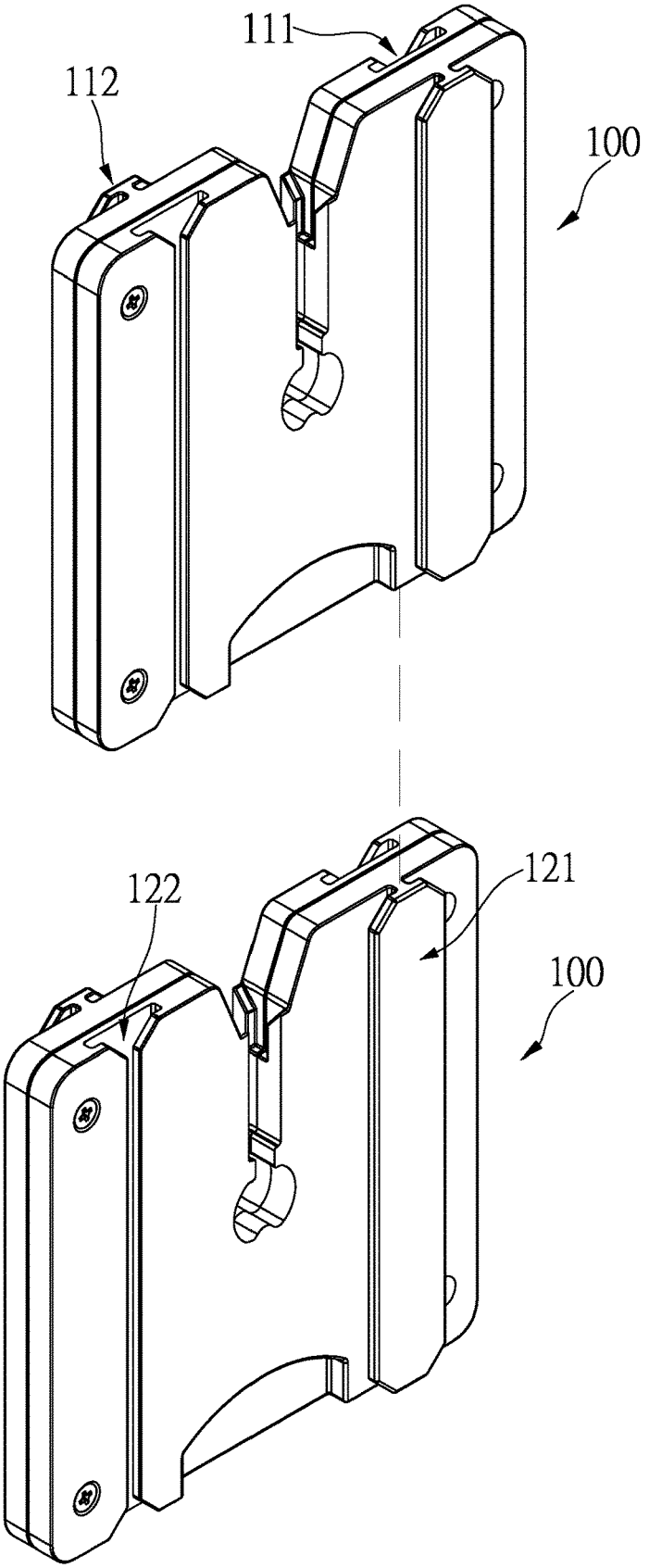
FIG. 3 is a schematic perspective view before the weight members assembled together.
Figure 4:
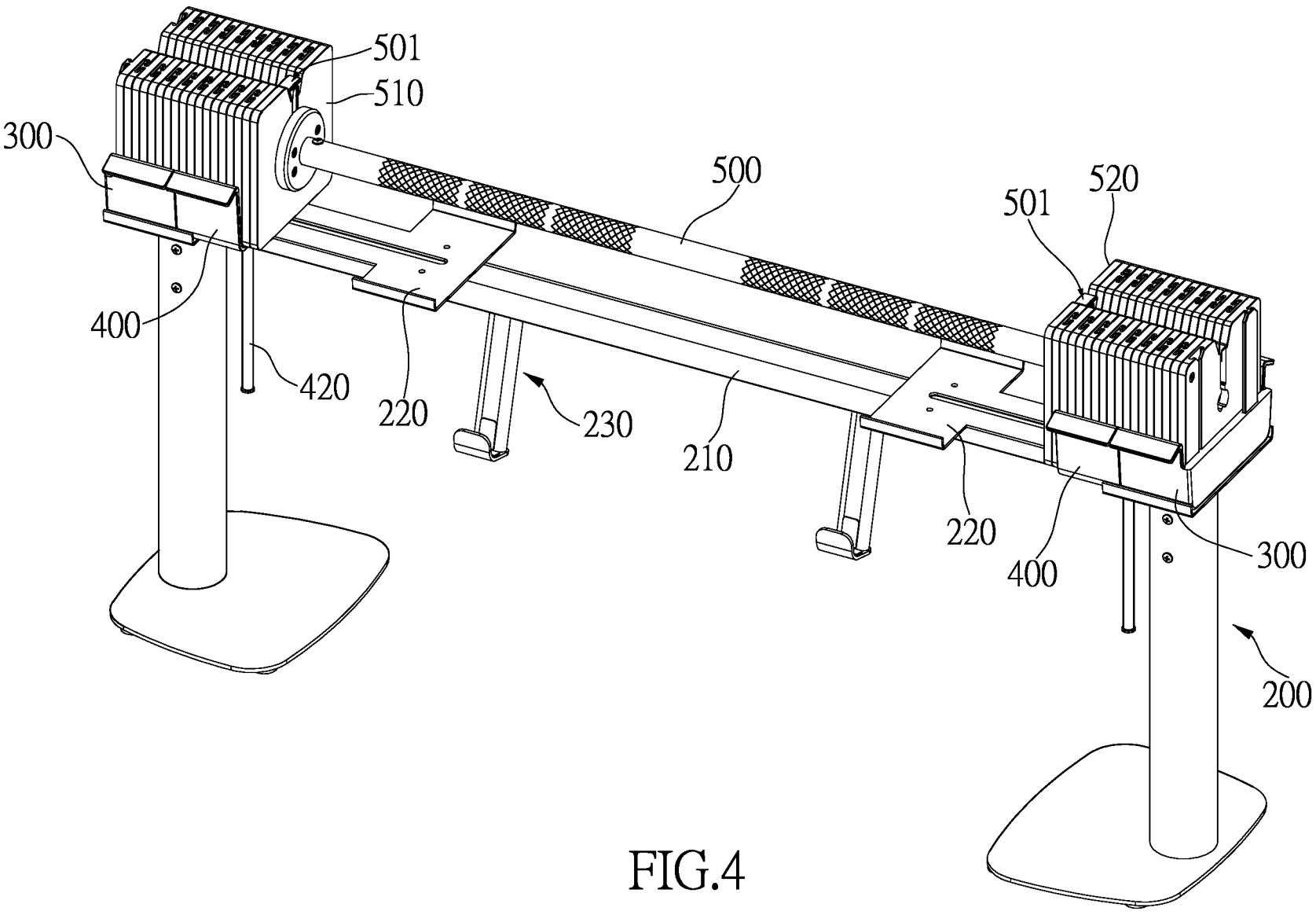
FIG. 4 is a perspective view of the barbell mode of the barbell and dumbbell device.
Figure 5:
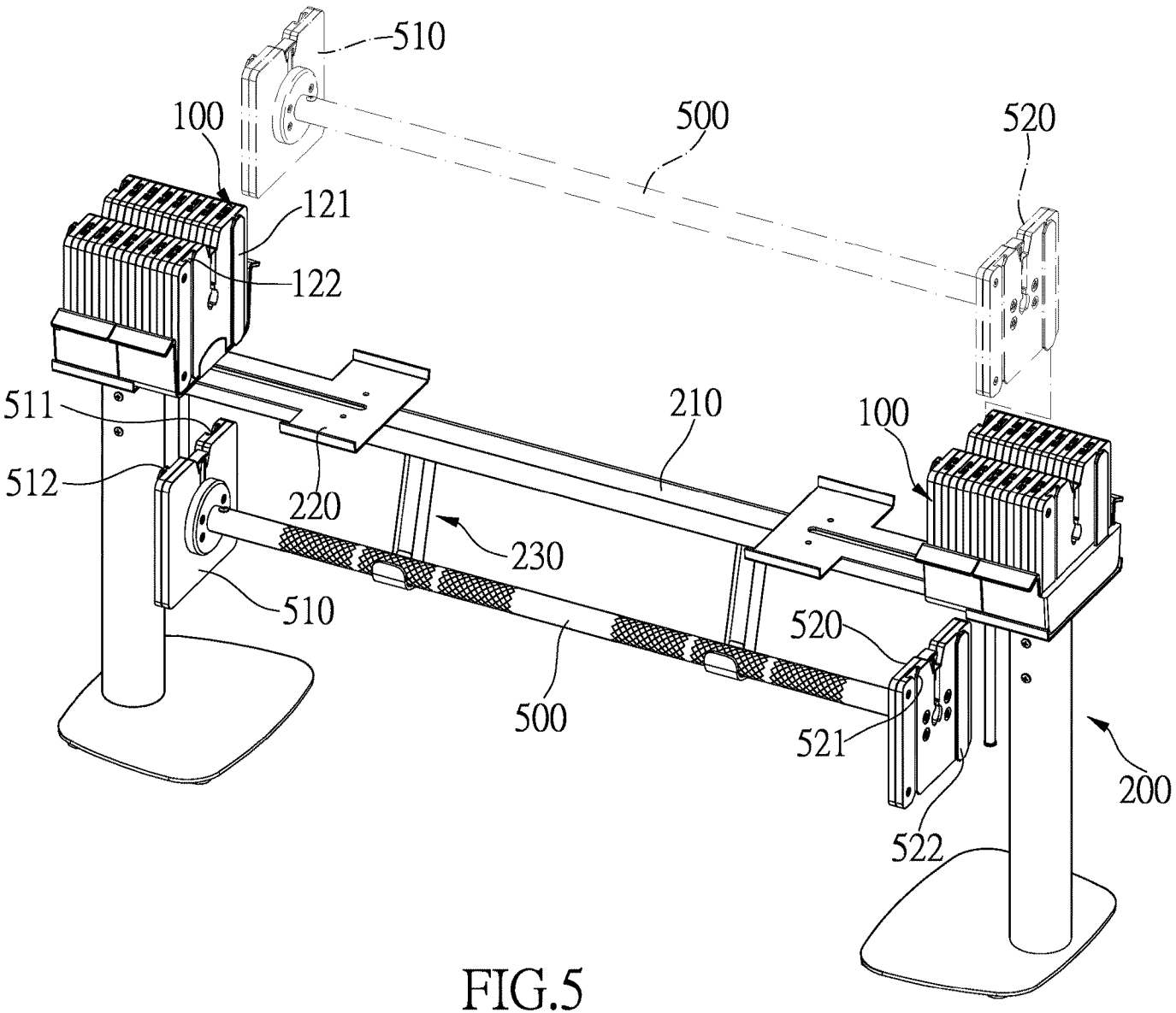
FIG. 5 is a schematic view of removing the barbell bar and placing it on the hanger.
Figure 6:
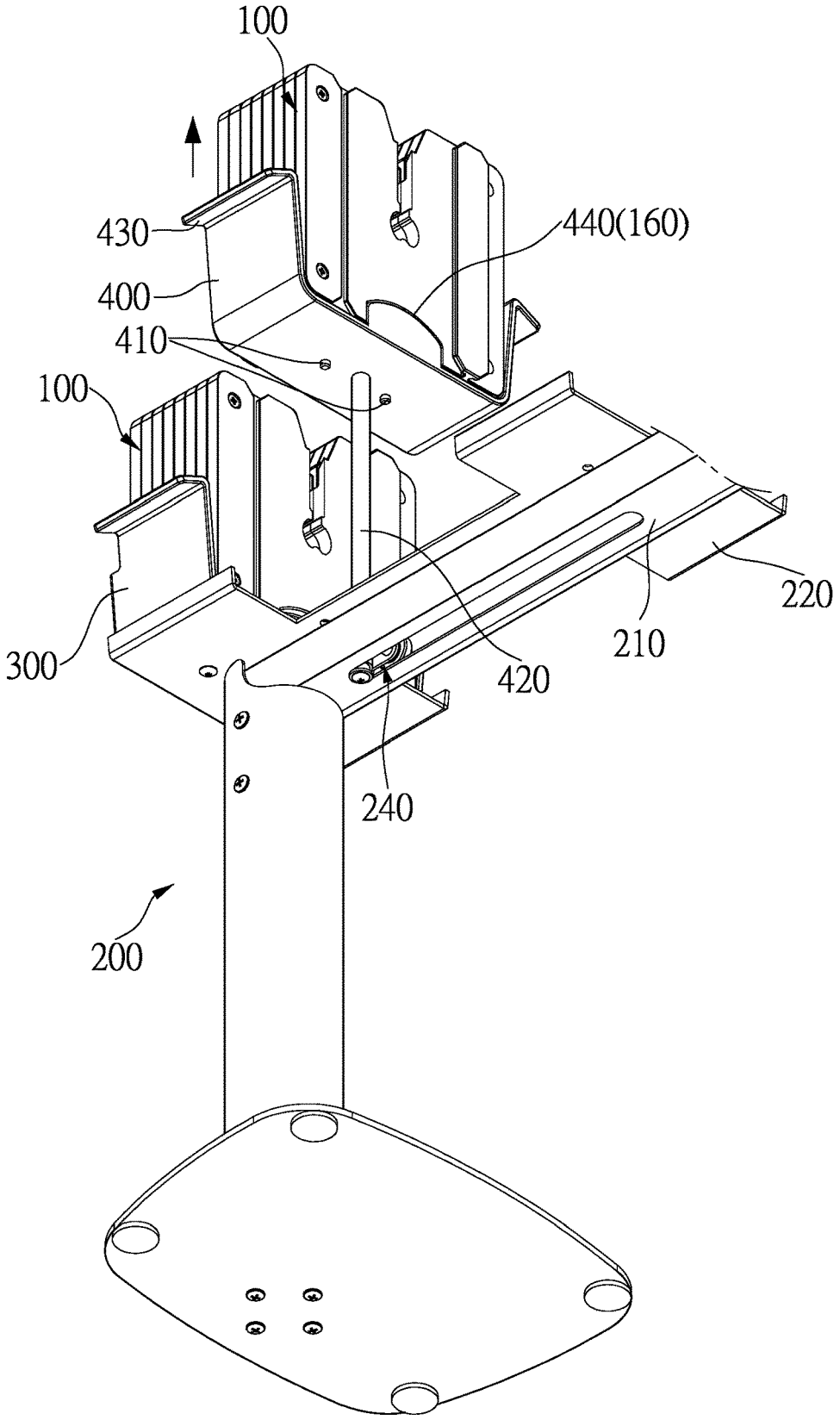
FIG. 6 is a schematic view of lifting the movable plate.
Figure 7:
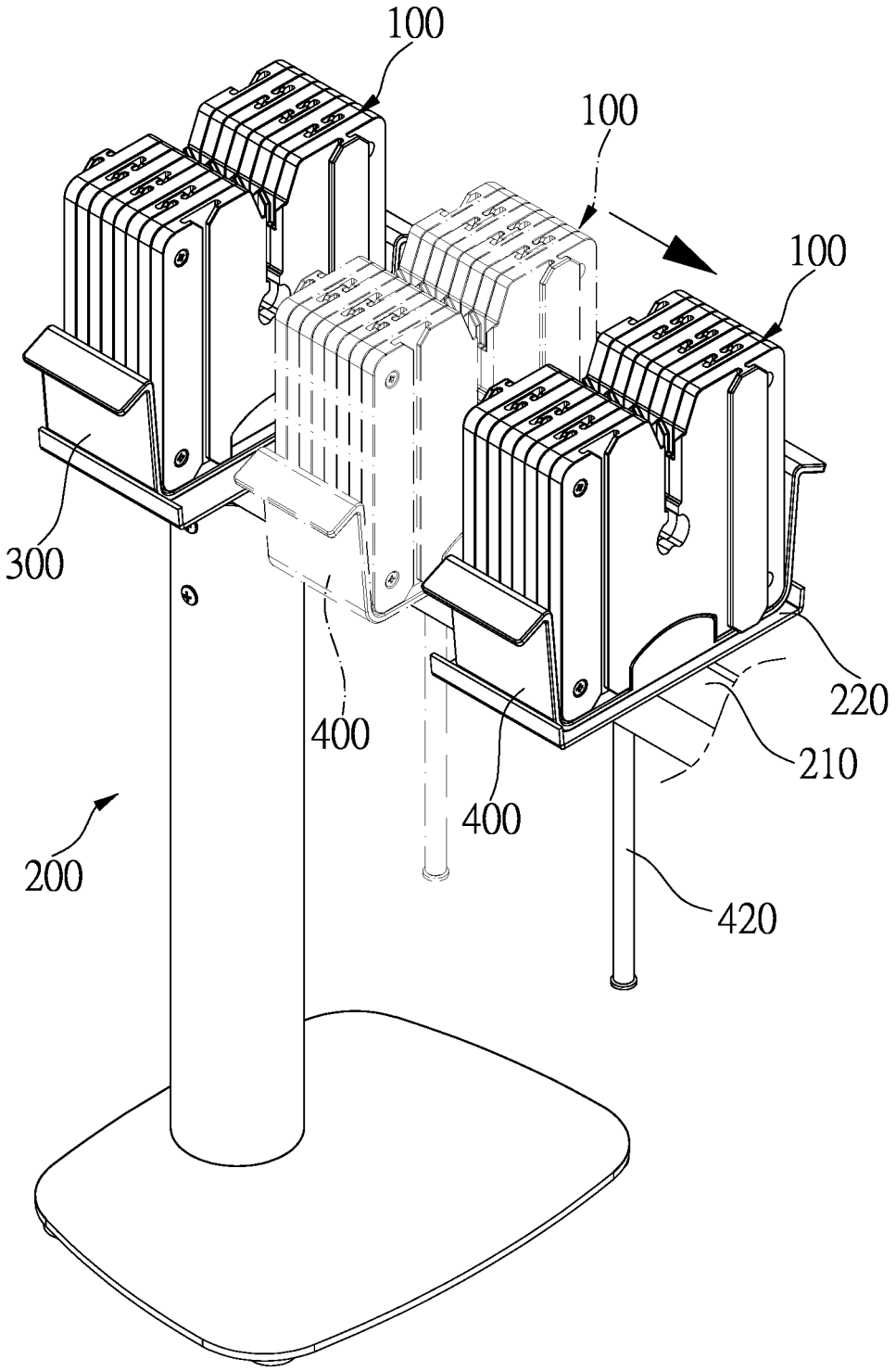
FIG. 7 is a schematic view of shifting the movable plate.
Figure 8:
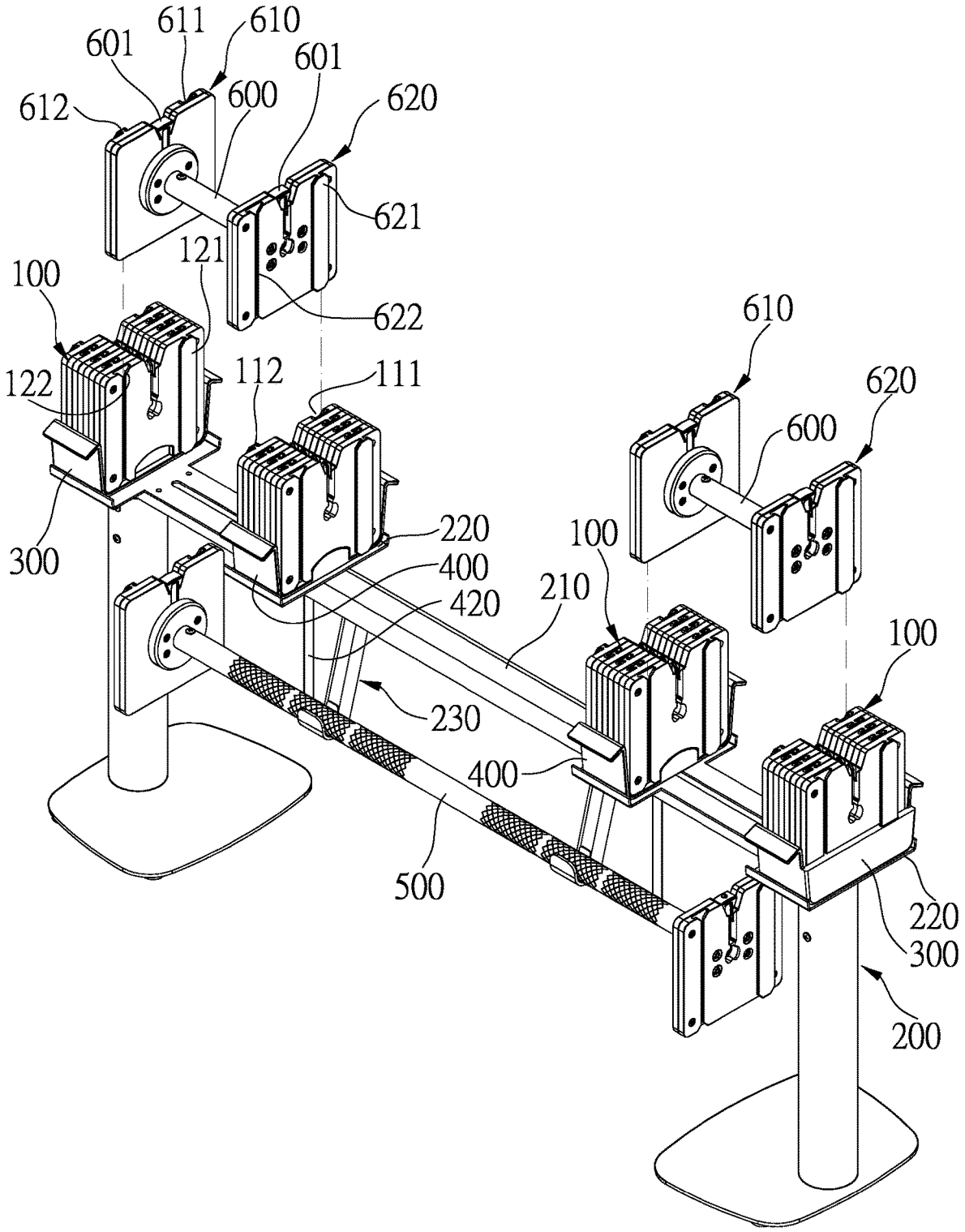
FIG. 8 is a schematic exploded perspective view of the dumbbell bar assembled with the weight members.
Figure 9:
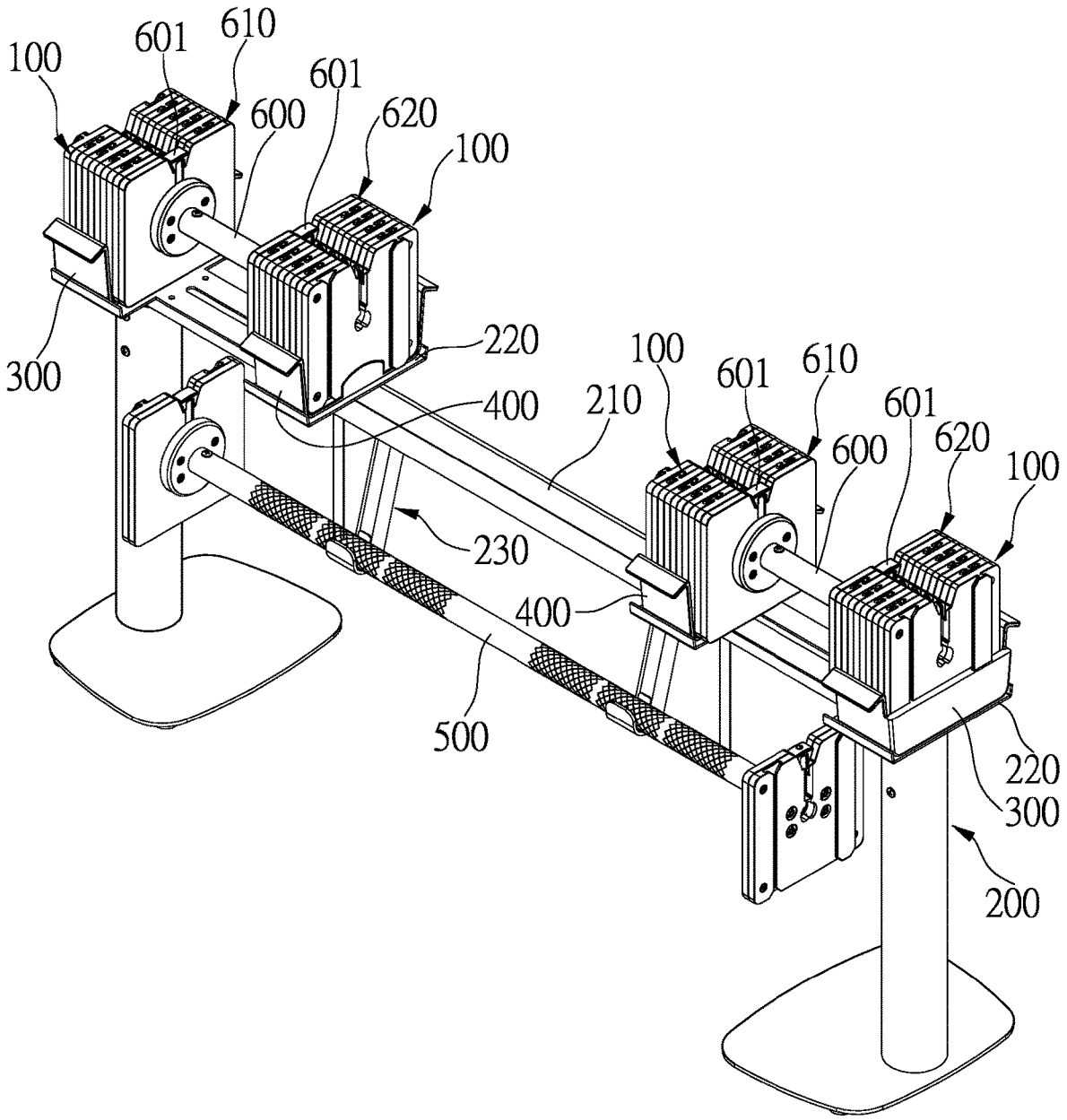
FIG. 9 is a perspective view of the dumbbell mode of the barbell and dumbbell device.

Referring to FIG. 1 to FIG. 3, the figures disclose a weight member 100, wherein the weight member 100 has a first side 110 and a second side 120 opposite to each other, and a split groove 130 through the first side and the second side. A first mortise and a first tenon are arranged on the first side, and a second mortise and a second tenon are arranged on the second side. The first mortise and the second tenon are arranged in opposite direction correspondingly, and the first mortise and the second tenon are opposite to each other and arranged correspondingly.

In operation of the weight member 100 of the present invention, when the weight members 100 are assembled together, the first mortise 111 and the first tenon 112 of the first side 110 of one weight member 100 is sliding interlocked with the second tenon 121 and the second mortise 122 of the second side 120 of another weight member 100 respectively.

Referring to FIG. 4 to FIG. 9, the figures disclose a barbell and dumbbell device 1, including: a base 200; a fastening plate 300 disposed on the base 200; a movable plate 400, placed on the base 200, a near position is provided when the movable plate 400 is moved adjacent to the fastening plate 300, and a distant position is provided when the movable plate 400 is moved away and spaced apart from the fastening plate 300, so that the movable plate 400 is movable between the near position and the distant position; weight members 100, disposed between the fastening plate 300 and the movable plate 400 moveably; the weight member 100 has a first side 110 and a second side 120 opposite to the first side 110, and the weight member 100 has a split groove 130 through the first side 110 and the second side 120; the first side 110 has a first mortise 111 and a first tenon 112, and the split groove 130 is located between the first mortise 111 and the first tenon 112, and the second side 120 has a second tenon 121 and a second mortise 122, and the split groove 130 is located between the second tenon 121 and the second mortise 122; the first mortise 111 and the second tenon 121 are arranged in opposite direction correspondingly, and the first tenon 112 and the second mortise 122 are arranged opposite to each other correspondingly; the first mortise 111 and the first tenon 112 of one weight member is sliding interlocked with the second tenon 121 and the second mortise 122 of another weight member respectively; a barbell bar 500, a barbell mode is provided when both ends of the barbell bar 500 engaged with the weight members 100 of the movable plates 400 located at the near positions respectively; and a dumbbell bar 600, a dumbbell mode is provided when both ends of the dumbbell bar 600 engaged with the weight members 100 of the fastening plate and the weight members 100 of the movable plate 400 located at the distant position respectively.

The weight member 100 is provide with the first mortise 111 and the first tenon 112 on the first side 110, and the second tenon 121 and the second mortise 122 on the second side 120. Further, the first mortise 111 and the second tenon 121 are disposed in opposite directions, and the first tenon 112 and the second mortise 122 are disposed in opposite side, which allow the first mortise 111 and the first tenon 112 of the first side 110 of one weight member 100 slide interlocked with the second tenon 121 and the second mortise 122 of the second side 120 of another weight member 100 respectively when the weight members 100 are assembled with each other. Therefore, the strength of the structural combination between the two weight members is improved, part of the gravity can be dispersed in the sliding interlocked portions during the weight training operation, so as to overcome the defect in conventional art.

The detailed features of each element and its assembling of the present invention are described as follows. The split groove 130 has a virtual center line L extending outward, and the first mortise 111, the first tenon 112, the second tenon 121 and the second mortise 122 are disposed extending parallel to the virtual center line L and spaced apart from the virtual center line L. With the above-mentioned structure and configuration, it can be assembled and removed in the same direction. In particular, the weight members 100 are heavy, this arrangement provides the effect of stability and high safety to keep the weight members from slipping off when assembling and removal.

The weight member includes a first portion 140 and a second portion 150 stacked together; the first mortise 111 and the first tenon 112 are located in the first portion 140, and the second mortise 122 and the second tenon 121 are located in the second portion 150. Therefore, the first portion 140 and the second portion 150 can be produced respectively and headedly assembled into a sheet shape, so that the weight member 100 is easy to process and manufacture, and easy to be assembled.

The first mortise 111 and the first tenon 112 are located in the first side 110 and extended from the top to the bottom continuously, and the second mortise 121 and the second tenon 122 are located in the second side 120 and extended from the top to the bottom continuously. By virtue of the continuous extension shape, the weight members 100 are completely sliding interlock with each other, thus increasing more contacting area compared with the conventional art, so that the weight members 100 are more stable.

Both ends of the barbell bar 500 combine with a first connecting plate 510 and a second connecting plate 520 respectively; the first connecting plate 510 has a first connecting mortise 511 and a first connecting tenon 512 interlocked with the second tenon 121 and the second mortise 122 of the weight member 100 respectively; the second connecting plate 520 has a second connecting mortise 521 and a second connecting tenon 522 interlocked with the first tenon 111 and the first mortise 112 of the weight member 100 respectively (the first connecting mortise 511 and the second connecting tenon 521 are arranged opposite to each other, and the first connecting tenon 512 and the second connecting mortise 522 are arranged opposite to each other).

Both ends of the dumbbell bar 600 combine with a first engaging plate 610 and a second engaging plate 620 respectively; the first engaging plate 610 has a first engaging mortise 611 and a first engaging tenon 612 interlocked with the second tenon 121 and the second mortise 122 of the weight member 100 respectively; the second engaging plate 620 has a second engaging mortise 621 and a second engaging tenon 622 interlocked with the first tenon 111 and the first mortise 112 of the weight member 100 respectively. (the first engaging mortise 611 and the second engaging tenon 621 are arranged opposite to each other, and the first engaging tenon 612 and the second engaging mortise 622 are arranged opposite to each other) By the structure arrangement, both the barbell bar 500 and the dumbbell bar 600 can be interlocked with the weight member 100, the strength of the structural combination between the bar and the weight member can be improved, and part of the gravity can be dispersed in the sliding connected portions during the weight training operation.

Figure 10:
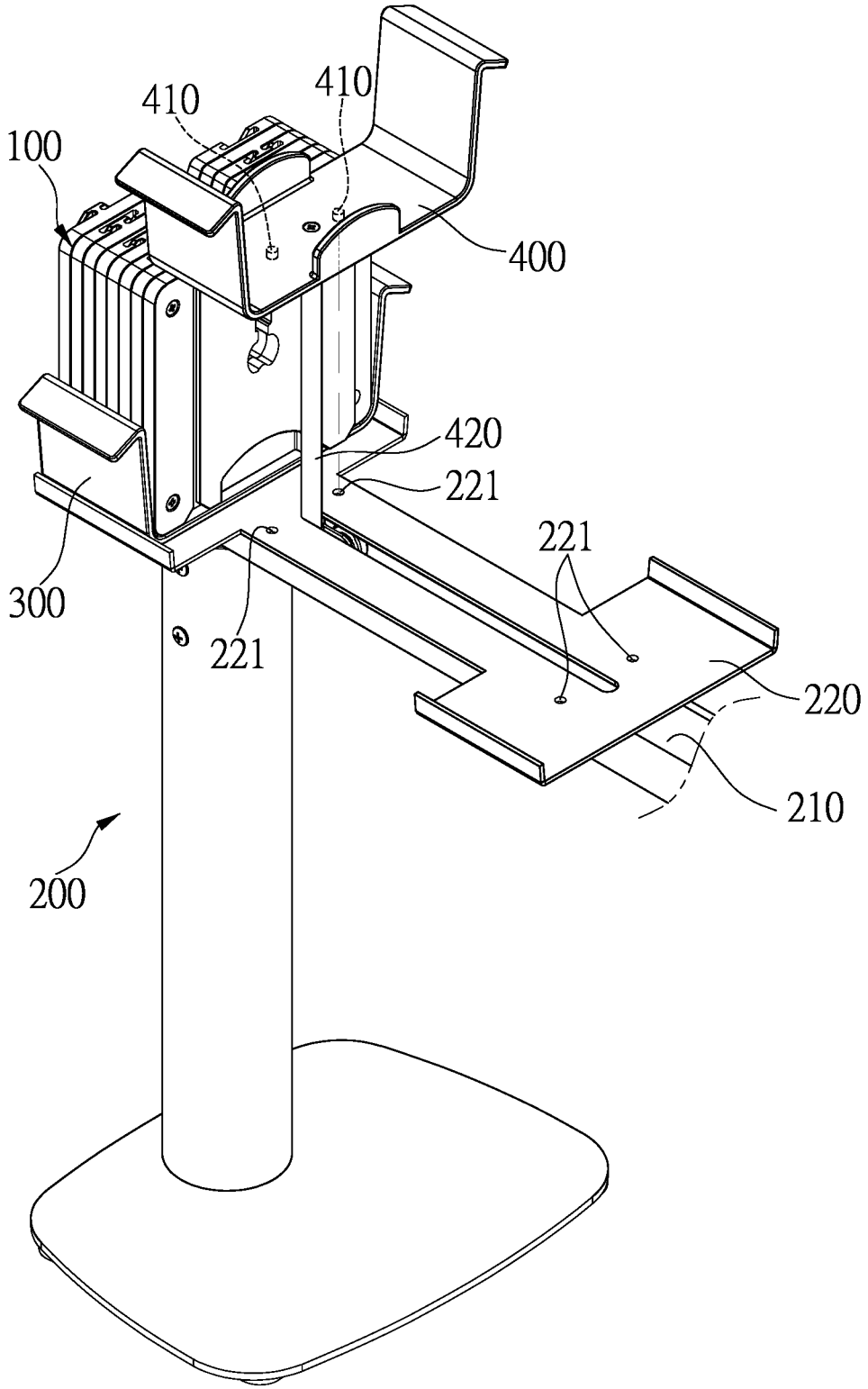
FIG. 10 is an exploded perspective view of the movable plate and the supporting plate.

The base 200 includes a horizontal bracket 210 and a supporting plate 220 disposed on the horizontal bracket 210 (located near the side); the supporting plate 400 has a limiting part 221 on the near position and the distant position respectively, and the movable plate 400 has an attaching part 410 movable fitting the limiting part 221. As shown in FIG. 10, in one embodiment as an example, the limiting part 221 is in a through hole structure, and the attaching part 410 is a convex pin structure; the attaching part 410 can movably attach to the limiting part 221 to keep the movable plate 400 fixed at a close position or the distant position of the supporting plate 220 temporarily, and to prevent the movable plate 400 from shifting on the supporting plate 220. The fastening plate 300 is fixed on the supporting plate 220 and adjacent to the near position; the movable plate 400 is connected with one side of a vertical rod 420 passing through the supporting plate 220 and the horizontal bracket 210, so that another side of the vertical rod 420 limits the movable plate 400 from completely detaching from the horizontal bracket 210, and the horizontal bracket 210 has a set of rollers 240 which slides between the near position and the distant position and allows the vertical rod 420 to move with the set of rollers simultaneously, and the vertical rod can pass through the set of rollers along the vertical direction.

In addition, the horizontal bracket 210 of the base 200 is provided with a hanger 230 for placing the barbell bar 500 to keep the barbell bar 500 when switching to the dumbbell mode for weight training. The movable plate 400 has handle portions 430 on the corresponding sides extending outward, which is used to move the movable plate 400 by holding the handle portion 430.

Referring to FIG. 4 to FIG. 9, the operation of switching between the barbell mode and the dumbbell mode of the barbell and dumbbell deice 1 would be further described as follows. Firstly, release the latching mechanism 501 of the barbell bar 500 on the split groove 130 of the weight member 100, and pull it hack to the first connecting plate 510 and the second connecting plate 520 of the barbell bar 500, then move the barbell bar 500 upward from the base 200, disassemble the sliding interlocking state between the first connecting plate 510 and the second connecting plate 520 of the barbell bar 500 and the weight members 100 on the movable plate 400. Lift upward the movable plate 400 with the weight member 100 on it by holding the two handle portions 430, which disassemble the sliding interlocking state between the weight members 100 on the movable plate 400 and the weight members 100 on the fastening plate 300 (the lifting movement of the movable plate 400 is limited to the bottom side of the horizontal bracket 210 by the end of the vertical rod 420). Further, the movable plate 400 and the weight member 100 on are pushed to the distant position, or moved to the top of the distant position and then placed at the distant position after the lifting movement. After the position adjustment of the movable plate 400 is completed, the dumbbell bar 600 can be held to the top between the fastening plate 300 and the movable plate 400, and put it down to assemble it, so that the first engaging plate 610 and the second engaging plate 620 at both ends of the dumbbell bar 600 can be sliding interlocked respectively with the weight members 100 on the fastening plate 300 and the weight members 100 on the movable plate 400. Finally, the latching mechanism 601 of the dumbbell bar 600 moves to the position with the desired numbers of the weight members 100 and secured, so that the dumbbell mode can be provided for weight training. Thereby, switching from the dumbbell mode to the barbell mode can be achieved by reversing the above description substantially.

Figure 11:
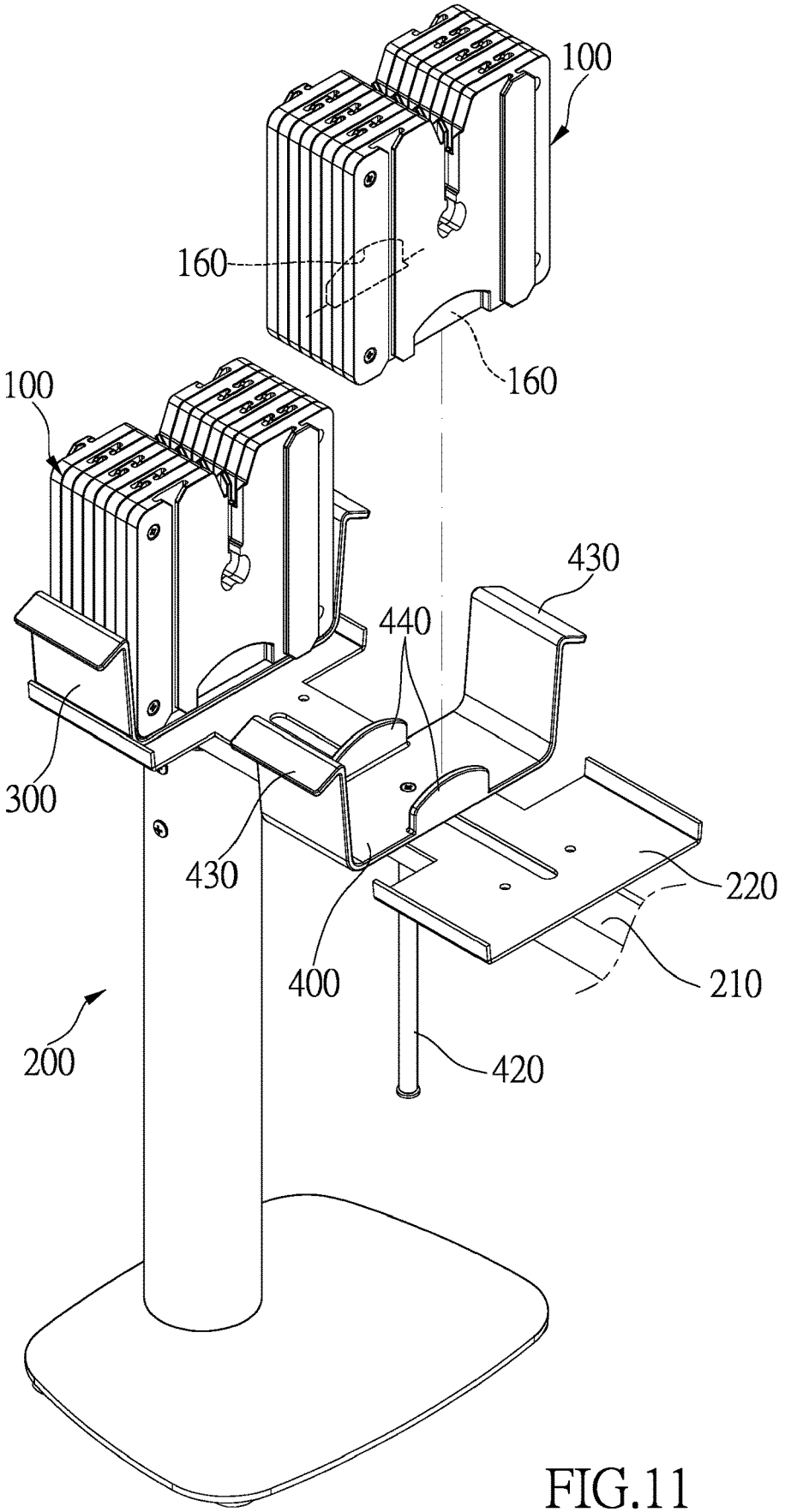
FIG. 11 is an exploded perspective view of the weight member and the movable plate.

Referring to FIG. 1, FIG. 2 and FIG. 11, each of the bottom sides of the first portion 140 and the second portion 150 has a side groove 160, and the side grooves 160 of the first portion 140 and the second portion 150 are not connected and not connected to the split groove 130; the two sides of the movable plate 400 have a blocking piece 440 engaged and fixed in the side groove 160 of the weight member 100 to limit the weight member 100 from falling off from two ends of the movable plate 400.

Figure 12:
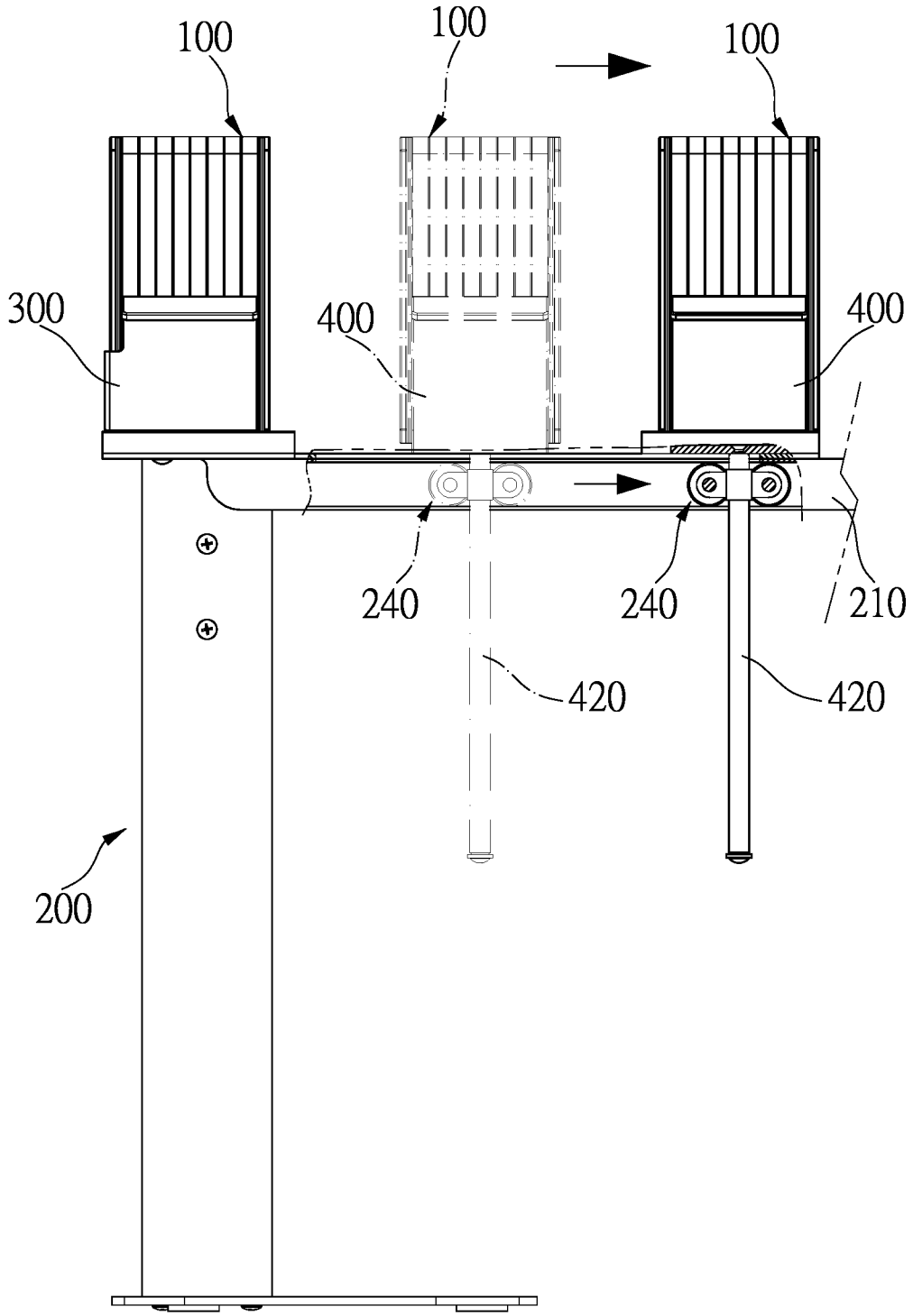
FIG. 12 is an operation schematic view of FIG. 7.

In the movement of shifting the movable plate 400 between the near position and the distant position, the roller set 240 is used to slide in the horizontal bracket 210. Especially when the movable plate 400 carries certain number of the weight member 100, it can provide a smooth movement for the movable plate 400 relative to the horizontal bracket 210, as shown in the FIG. 7 and FIG. 12.

It is worth mentioning that the conventional arts Taiwan Patent No. M613036, No. M594976, and the U.S. Ser. No. 11/207,557B2, etc. provide the dumbbell and barbell sets, when operating to switch between the barbell mode and the dumbbell mode, the supporting table (plate) must be rotated 180 degrees to complete the assembly of the weight member and the bar due to the reason of the single dovetail corresponding the single dovetail slot, which is not convenient in operation. Accordingly, the weight member 100 of the present invention provides the first mortise 111 and the second tenon arranged in opposite direction, and the first mortise 112 and the second tenon 122 are arranged in opposite direction, and cooperates with the configuration of the first connecting plate 510 (the arrangement of the first connecting mortise 511 and the first connecting tenon 512) and the second connecting plate 520 (the arrangement of the second connecting tenon 521 and the second connecting mortise 522) of the barbell bar, and the first engaging plate 610 (the arrangement of the first engaging mortise 611 and the first engaging tenon 612) and the second engaging plate 620 (the arrangement of the second engaging tenon 621 and the second engaging mortise 622) of the dumbbell bar, the barbell mode and dumbbell mode can be switched without changing the direction of the weight member 100.

What is claimed is:

1. A weight member wherein:

the weight member includes a first side and a second side opposite to each other, and the weight member has a split groove through the first side and the second side and opening outward;

the first side has a first mortise and a first tenon, and the split groove is located between the first mortise and the first tenon;

the second side has a second tenon and a second mortise, and the split groove is located between the second tenon and the second mortise, and the first mortise and the second tenon are arranged opposite to each other correspondingly, and the first tenon and the second mortise are arranged opposite to each other correspondingly.

2. The weight member according to claim 1, wherein the weight member includes a first portion and a second portion stacked together; the first mortise and the first tenon are located in the first portion, and the second mortise and the second tenon are located in the second portion.

3. The weight member according to claim 2, wherein each of bottom sides of the first portion and the second portion has a groove.

4. The weight member according to claim 1, wherein the split groove has a virtual center line extending outward, and the first mortise, the first tenon, the second tenon and the second mortise are disposed extending parallel to the virtual center line and spaced apart from the virtual center line.

5. The weight member according to claim 1, wherein the first mortise and the first tenon are located in the first side and extend from a top to a bottom continuously, and the second mortise and the second tenon are located in the second side and extend from a top to a bottom continuously.

6. A barbell and dumbbell device comprising:

a base;

two fastening plates, disposed on the base;

two movable plates, placed on the base, in which a near position is provided when each of the movable plates is moved adjacent to a corresponding one of the fastening plates, and a distant position is provided when each of the movable plates is moved away and spaced apart from the corresponding one of the fastening plates, so that each of the movable plates is movable between the near position and the distant position;

weight members, each weight member configured to be movably disposed on a corresponding one of the two fastening plates or one of the two movable plates; each of the weight members has a first side and a second side opposite to each other, and each of the weight members has a split groove through the first side and the second side; the first side of each of the weight members has a first mortise and a first tenon, and the split groove is located between the first mortise and the first tenon, and the second side of each of the weight members has a second tenon and a second mortise, and the split groove is located between the second tenon and the second mortise; the first mortise and the second tenon are arranged opposite to each other correspondingly, and the first tenon and the second mortise are arranged opposite to each other correspondingly; the first mortise and the first tenon of one of the weight members is sliding interlocked with the second tenon and the second mortise of another one of the weight members respectively;

a barbell bar, wherein a barbell mode is provided when both ends of the barbell bar engage with corresponding weight members disposed on the two movable plates; and a dumbbell bar, wherein a dumbbell mode is provided when both ends of the dumbbell bar engage with corresponding weight members disposed on the two fastening plates and corresponding weight members disposed on the two movable plates when each of the movable plates is located at the distant position respectively.

7. The barbell and dumbbell device according to claim 6, wherein the split groove of each weight member has a virtual center line extending outward, and the first mortise, the first tenon, the second tenon and the second mortise of each weight member are disposed extending parallel to the respective virtual center line and spaced apart from the respective virtual center line; each of the weight members includes a first portion and a second portion stacked together, the first mortise and the first tenon are located in the first portion, and the second mortise and the second tenon are located in the second portion; the first mortise and the first tenon of each weight member are located in the respective first side and extend from a top to a bottom continuously, and the second mortise and the second tenon of each weight member are located in the respective second side and extend from a top to a bottom continuously.

8. The barbell and dumbbell device according to claim 7, wherein each of bottom sides of the first portion and the second portion of each of the weight members has a groove; two sides of each movable plate have a blocking piece configured to removably engage with the groove of a corresponding one of the weight members to limit the corresponding weight members from falling off from two ends of the movable plate.

9. The barbell and dumbbell device according to claim 6, wherein each end of the barbell bar respectively combines with one of a first connecting plate and a second connecting plate; the first connecting plate has a first connecting mortise and a first connecting tenon interlocked with the second tenon and the second mortise of one of the weight members respectively; the second connecting plate has a second connecting mortise and a second connecting tenon interlocked with the first tenon and the first mortise of another one of the weight members respectively.

10. The barbell and dumbbell device according to claim 6, wherein each end of the dumbbell bar respectively combines with one of a first engaging plate and a second engaging plate; the first engaging plate has a first engaging mortise and a first engaging tenon interlocked with the second tenon and the second mortise of one of the weight members respectively; the second engaging plate has a second engaging mortise and a second engaging tenon interlocked with the first tenon and the first mortise of another one of the weight members respectively.

11. The barbell and dumbbell device according to claim 6, wherein the base includes a horizontal bracket and two supporting plates disposed on the horizontal bracket;

each supporting plate has two limiting parts and each limiting part is a through hole, wherein the two limiting parts are located corresponding to the near position and the distant position of a respective one of the two movable plates, and each movable plate has an attaching part which is a convex pin and movably fits a respective one of the limiting parts;

each fastening plate is respectively fastened to one of the two supporting plates and adjacent to the respective near position of one of the two movable plates;

each movable plate is connected with one side of a vertical rod passing through a respective one of the two supporting plates and the horizontal bracket, so that another side of the vertical rod limits the movable plate from completely detaching from the horizontal bracket, and the horizontal bracket has two sets of rollers, each movable plate is slidable between the near position and the B distant position by a respective one of the two sets of rollers disposed on the horizontal bracket such that the respective vertical rod moves with the set of rollers simultaneously and passes through the set of rollers along the vertical direction.

* * * * *